US008430211B2

(12) United States Patent
Dif

(10) Patent No.: US 8,430,211 B2
(45) Date of Patent: Apr. 30, 2013

(54) ELEVATOR SYSTEM WITH GUIDE AXIS ALIGNED WITH TRACTION MEMBER

(75) Inventor: Jerome Dif, Saint Pere sur Loire (FR)

(73) Assignee: Otis Elevator Company, Farmington, CT (US)

( * ) Notice: Subject to any disclaimer, the term of this patent is extended or adjusted under 35 U.S.C. 154(b) by 526 days.

(21) Appl. No.: 12/602,900

(22) PCT Filed: Jun. 8, 2007

(86) PCT No.: PCT/EP2007/005099

§ 371 (c)(1),
(2), (4) Date: Dec. 3, 2009

(87) PCT Pub. No.: WO2008/148414

PCT Pub. Date: Dec. 11, 2008

(65) Prior Publication Data

US 2010/0181149 A1 Jul. 22, 2010

(51) Int. Cl.
*B66B 11/08* (2006.01)
*B66B 11/02* (2006.01)

(52) U.S. Cl.
USPC ..... 187/266; 187/401

(58) Field of Classification Search ..... 187/266, 187/401
See application file for complete search history.

(56) References Cited

U.S. PATENT DOCUMENTS

| | | | | |
|---|---|---|---|---|
| 3,101,130 | A * | 8/1963 | Bianca | 187/244 |
| 5,899,300 | A * | 5/1999 | Miller et al. | 187/256 |
| 6,491,136 | B2 * | 12/2002 | Kobayashi et al. | 187/254 |
| 6,715,587 | B2 * | 4/2004 | Sittler et al. | 187/401 |
| 6,848,543 | B2 | 2/2005 | Adifon et al. | |
| 7,377,366 | B2 * | 5/2008 | Det et al. | 187/406 |
| 2001/0047908 | A1 * | 12/2001 | Murakami et al. | 187/266 |
| 2004/0173411 | A1 * | 9/2004 | Silberhorn et al. | 187/277 |

FOREIGN PATENT DOCUMENTS

| | | | |
|---|---|---|---|
| DE | 101 54 171 | A1 | 5/2003 |
| JP | 2004292162 | A | 10/2004 |
| JP | 2006507200 | A | 2/2006 |
| WO | WO 99 43590 | A | 9/1999 |
| WO | WO 01 74704 | A1 | 10/2001 |
| WO | WO 2004048246 | A1 * | 6/2004 |

OTHER PUBLICATIONS

International Search Report & Written Opinion—PCT/EP2007/005099—filed Jun. 8, 2007.
The US translation of the Office Action dated Mar. 21, 2012 and the translation letter dated Apr. 23, 2012.

* cited by examiner

*Primary Examiner* — Michael Mansen
*Assistant Examiner* — Minh Truong
(74) *Attorney, Agent, or Firm* — Kinney & Lange, P.A.

(57) ABSTRACT

An elevator car assembly includes a car frame, a car connected to the car frame and having a first guide axis between a first side and a second side of the car frame, a plurality of traction members, a first plurality of sheaves rotatably connected to the car frame between the first side and the second side for respectively receiving the plurality of traction members, and a first guide attached to either the car frame or the car below the first plurality of sheaves for movably engaging a first rail. The first guide is aligned with the first guide axis and is configured to be aligned with the first rail. One of the plurality of traction members and the first guide are vertically aligned at the first guide axis.

22 Claims, 4 Drawing Sheets

ELEVATOR SYSTEM WITH GUIDE AXIS ALIGNED WITH TRACTION MEMBER

BACKGROUND

The present invention relates to an elevator system. More particularly, the invention relates to a traction elevator system including a guide axis aligned with a traction member.

Traction elevator systems commonly include one or more guide rails running vertically on opposite sides of a hoistway. The guide rails commonly have a T-shaped horizontal cross-section with the top of the T attached to the side of the hoistway and the leg of the T extending into the hoistway toward the elevator car. The guide rails are arranged to guide the elevator car up and down the hoistway. Some traction systems may include a car frame attached to the elevator car. In systems including a car frame, the frame is attached to the car and connected to the guide rails such that the car frame, which rides vertically on the rails, carries the car up and down the hoistway. The connection at the guide rails, either between the car and the guide rails or between the car frame and the guide rails, commonly includes one or more guides, such as rollers or slides, which provide a sliding connection to the guide rails and often include damping devices to improve the ride quality of the elevator car. Some traction elevator systems also include sheaves provided above the car in, for example, a front to back arrangement along the sides of the car adjacent to the guide rails. Traction members, such as belts or ropes, loop around the sheaves and transmit force provided by a drive system, commonly called a hoist machine, to move the elevator car, and in some systems the car frame, up and down the hoistway along the guide rails.

Two important design considerations for elevator systems are the weight capacity, sometimes referred to as the duty, of the car and the ride quality of the car. The duty of the elevator car in traction systems depends upon the roping ratio (e.g., 2:1 or 3:1) as well as the number of traction members, for example belts, used to drive the car, and in some cases the car and the car frame. For example, for a given roping ratio, the duty of an elevator car driven by five traction belts is greater than the duty of an elevator car driven by four similar traction belts. Additionally, the ride quality of the elevator car may be related, in part, to the relative position of the traction belts with respect to the car and the path along which the car travels, i.e. the path along the guide rails.

In some traction elevator systems in which the sheaves are provided in a front-to-back arrangement along the sides of the top of the car frame, the traction members that engage the sheaves are arranged such that they do not interfere with the guides' interactions with the guide rails. Unfortunately, as a result of the guides' position relative to various traction members, the possibility of providing an additional traction member(s) in the location occupied by the guides is precluded, thereby reducing the duty that the car may otherwise be capable of lifting. Additionally, the position of the guides may prevent aligning one of the traction members with the guide and guide rails, thereby reducing the ride quality of the car.

In light of the foregoing, the present invention aims to resolve one or more of the aforementioned issues that afflict such traction elevator systems.

SUMMARY

The present invention includes an elevator car assembly comprising a car frame, a car connected to the car frame and having a first guide axis between a first side and a second side of the car frame, a plurality of traction members, a first plurality of sheaves rotatably connected to the car frame between the first side and the second side for respectively receiving the plurality of traction members, and a first guide attached to either the car frame or the car below the first plurality of sheaves for movably engaging a first rail. The first guide is aligned with the first guide axis and is configured to be aligned with the first rail. One of the plurality of traction members and the first guide are vertically aligned at the first guide axis.

Embodiments of the present invention also include an elevator system comprising a hoistway, one or more rails vertically disposed in the hoistway and respectively defining one or more guide axes, and an elevator car assembly. The elevator car assembly includes a car frame connected to a car and arranged with the one or more guide axes between a first side and a second side of the car frame, a plurality of traction members, a plurality of sheaves rotatably connected to the car frame between the first side and the second side for respectively receiving the plurality of traction members, and one or more guides attached to either the car or the car frame below the plurality of sheaves for respectively movably engaging the one or more rails. The one or more guides are respectively aligned with the one or more guide axes. One of the plurality of traction members is vertically aligned with the one or more guides at the one or more guide axes.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
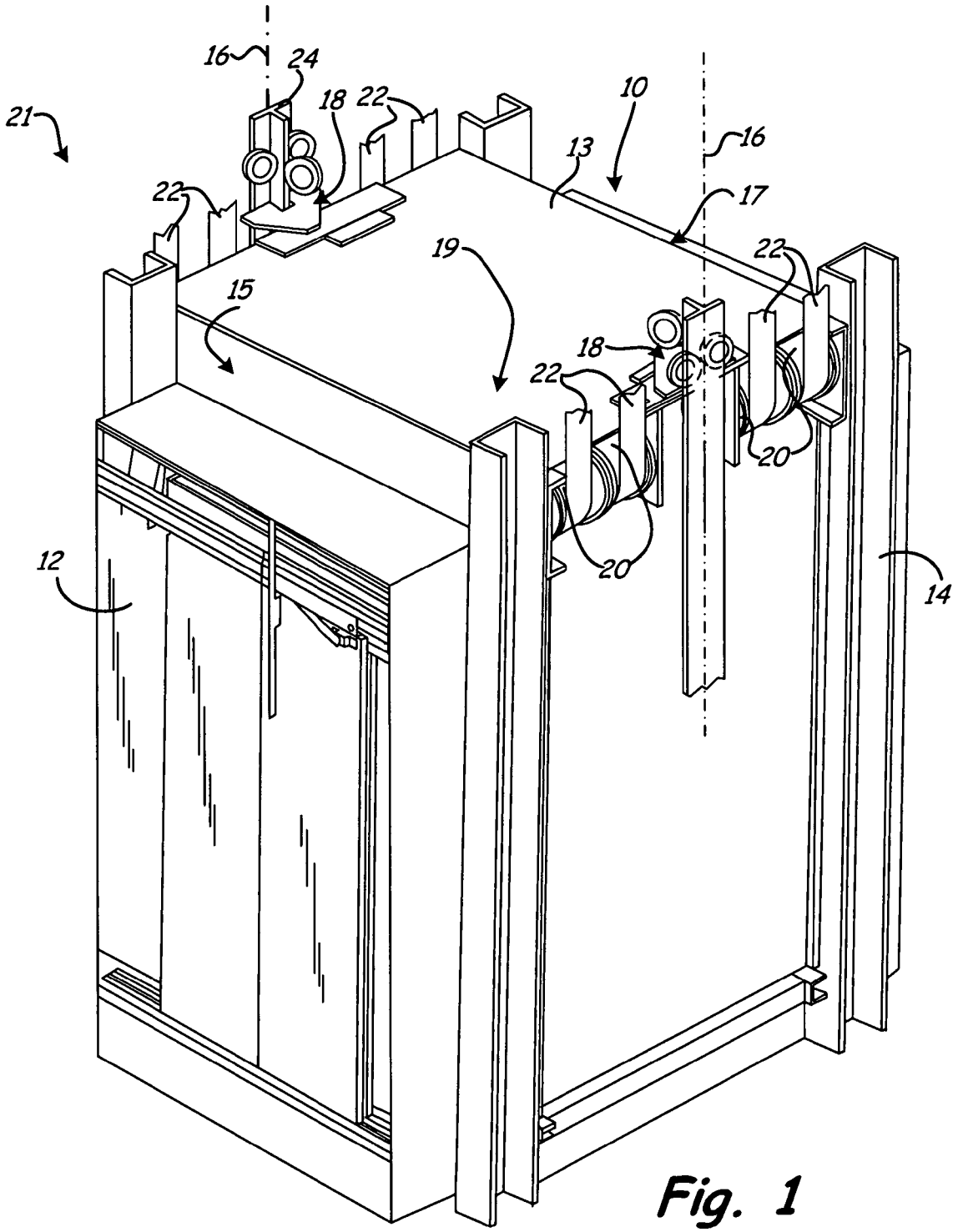
Fig. 1 PRIOR ART
FIG. 1 is a perspective view of a prior art elevator system.

Efforts have been made throughout the drawings to use the same or similar reference numerals for the same or like components.

FIG. 1 is a perspective view of a prior art elevator system 10, which includes a car 12, a frame 14, guide axes 16, roller guides 18, sheaves 20, belts 22, and guide rails 24. In FIG. 1, the car 12 is connected to the frame 14. The roller guides 18, the sheaves 20, and the belts 22 are connected to the top 13 of the frame 14. The roller guides 18 are connected to the top 13 of the frame 14 above the sheaves 20. The sheaves 20, which are positioned between a front, first side 15 and a second, rear side 17 of the car frame 14, are rotatably connected to the top 13 of the frame 14 below the roller guides 18. The belts 22, which are looped under the sheaves 20 on top 13 of the frame 14, travel below the top 13 of the frame 14 from a right, third side 19 to a left, fourth side 21 of the car frame 14 on opposite sides of the roller guides 18. The third and fourth sides 19, 21 of the car frame 14 are respectively provided adjacent opposite sides of a hoistway to which hoistway sides are attached the guide rails 24. The guide rails 24 run the length of the hoistway and are centered along the respective guide axes 16. The roller guides 18 are movably connected to the guide rails 24 to guide the car 12 and the frame 14 up and down the hoistway. The sheaves 20 and the belts 22 are arranged on opposite sides of the roller guides 18, which are adjacent the sides of the hoistway to which are attached the guide rails 24. The belts 22 transmit force provided by a drive system (not shown), for example a hoist machine, to move the car 12 and the frame 14 up and down the hoistway along the guide rails 24.

In FIG. 1, none of the four sheaves 20 or four belts 22 is aligned with the guide axes 16, and thereby none of the sheaves 20 or belts 22 is aligned with the roller guides 18. Rather, the sheaves 20 and the belts 22 are arranged on opposite sides of the guide axes 16 toward the front 15 and back 17 of the car frame 14.

Figure 2:
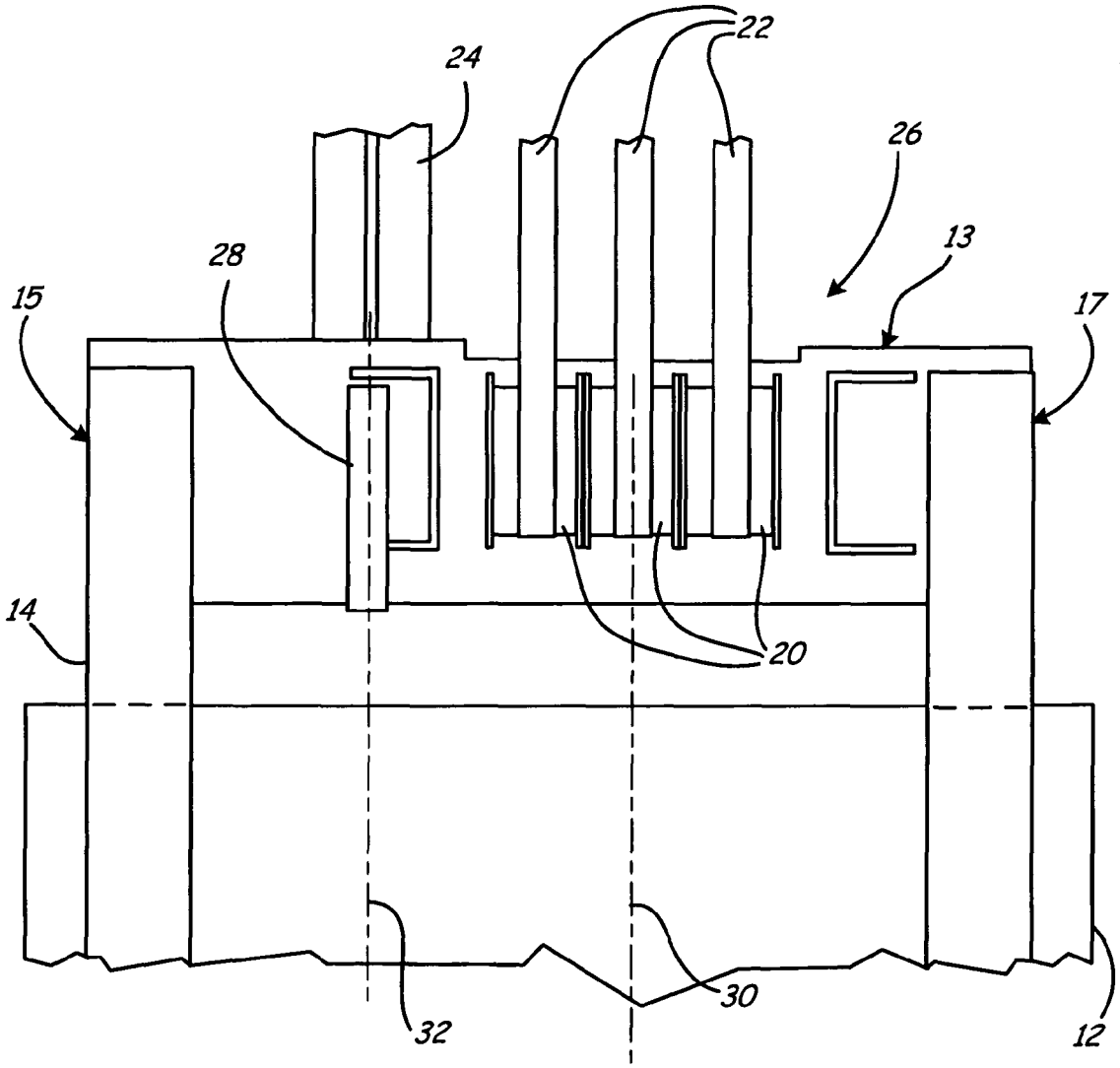
Fig. 2 PRIOR ART
FIG. 2 is a schematic partial side view of a prior art elevator system including an alternative guide and traction member arrangement.

FIG. 2 is a schematic side view of one side of an alternate prior art elevator system 26, which includes an alternative guide and traction member arrangement. In FIG. 2, a sliding guide 28, the sheaves 20, and the belts 22 are arranged in a line between the front 15 and the back 17 of the car frame 14 and connected to the top 13 of the frame 14. A traction axis 30 is centrally aligned with one of the three sheaves 20 and one of the three belts 22. The guide rail 24 runs the length of the hoistway and is centered along a guide axis 32. The sliding guide 28 is centrally aligned with and movably connected to the guide rail 24. The guide axis 32 is offset from the traction axis 30. As a result of the placement of the sliding guide 28, the number of sheaves 20 and belts 22 which may be used to drive the car 12 in system 26 is limited. Additionally, offsetting the guide axis 32 from the traction axis 30 may act to degrade the ride quality of the car 12 by creating a discontinuity between the path along which the car 12 travels, i.e. the guide axis 32, and the direction of the force moving the car 12 along this path, i.e. the traction axis 30.

Figure 3:
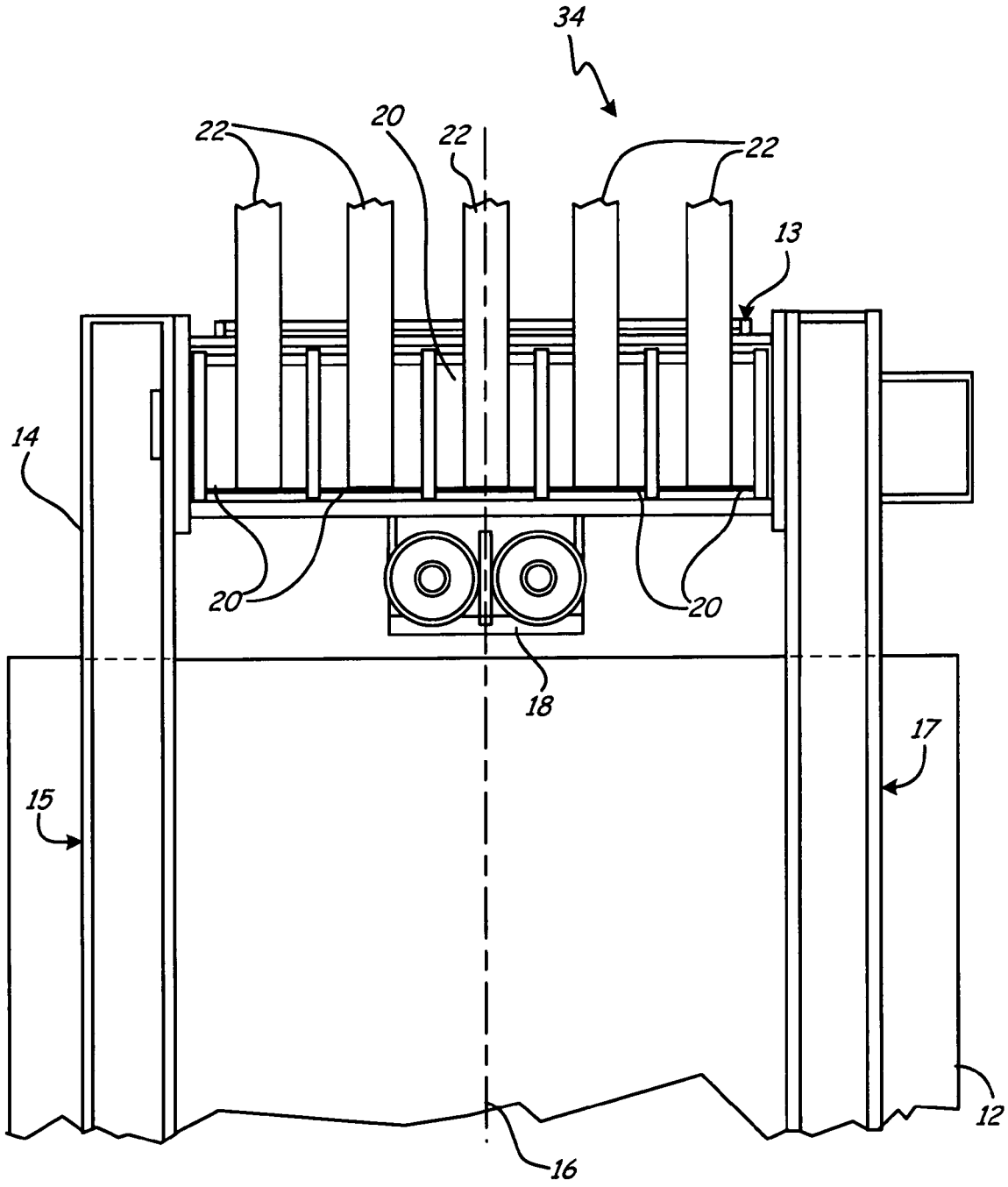
FIG. 3 is a schematic partial side view of an embodiment of an elevator system according to the present invention.

FIG. 3 is a schematic partial side view of one side 19 of an embodiment of an elevator system 34 according to the present invention, which view shows the car 12, the car frame 14, a guide axis 16, a roller guide 18, sheaves 20, and belts 22. In FIG. 3, the roller guide 18, the sheaves 20, and the belts 22 are connected to the top 13 of the frame 14. The roller guide 18 is connected to the top 13 of the frame 14 below the sheaves 20. The sheaves 20 are rotatably connected to the top 13 of the frame 14 above the roller guide 18. The belts 22 are looped under the sheaves 20 on top 13 of the frame 14 and above the roller guide 18.

In FIG. 3, the guide axis 16 may define a vertical center of the car 12, which is located halfway between, for example, the front 15 and the back 17 of the car frame 14. The guide axis 16, and thereby the vertical center of the car 12, is aligned with the roller guide 18, which is aligned with and movably engages the guide rail 24 (see FIG. 4). One of the five sheaves 20 and one of the five belts 22 may also be aligned with the guide axis 16, and thereby with the vertical center of the car 12. The remaining four of the five sheaves 20 and the remaining four of the five belts 22 may be, as is shown in FIG. 3, arranged on opposite sides of the guide axis 16, and the vertical center of the car 12, toward the front 15 and back 17 of the car frame 14.

Figure 4:
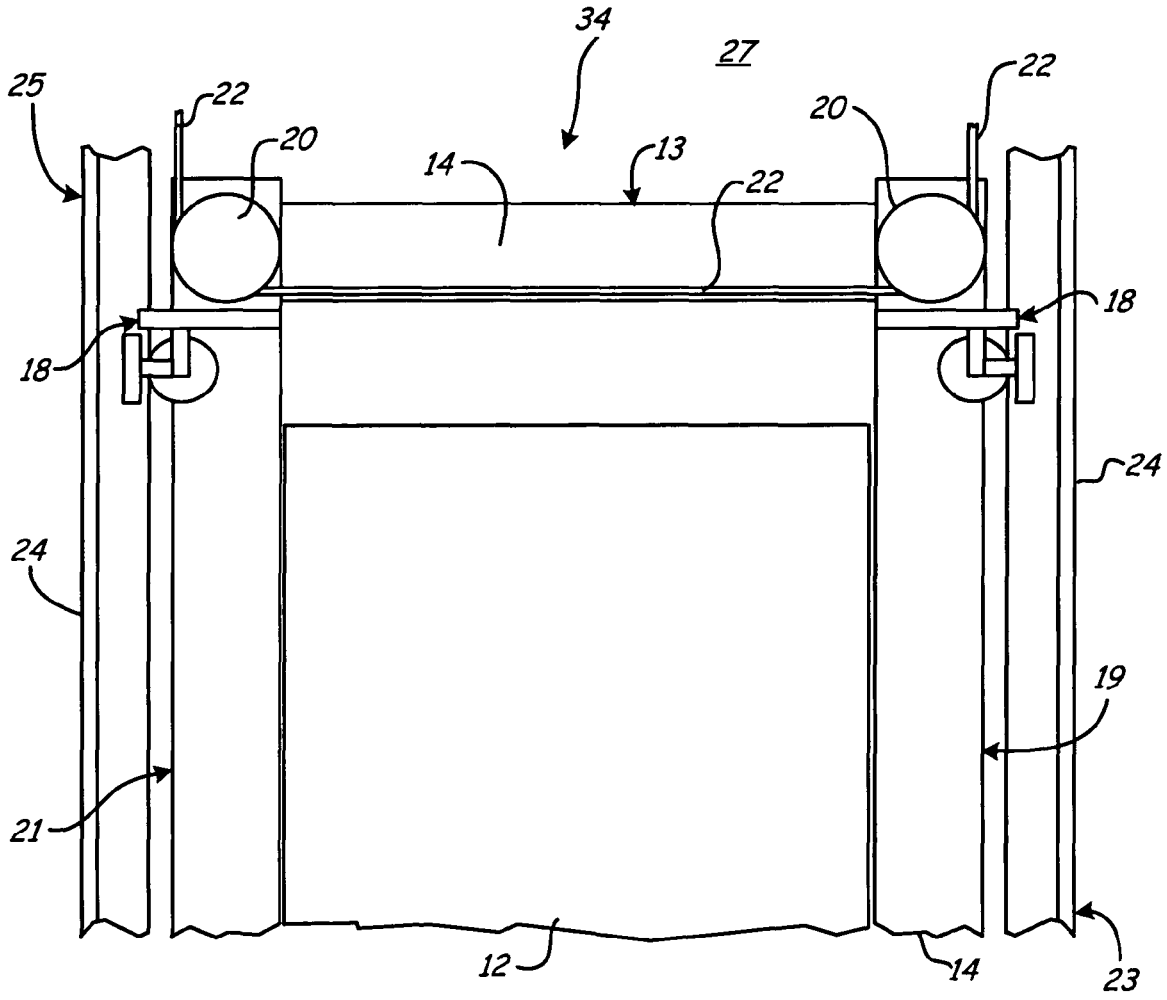
FIG. 4 is a schematic partial front view of the elevator system of FIG. 3.

FIG. 4 is a schematic partial front view of the elevator system 34 of FIG. 3 showing the relative arrangement of the system 34 with respect to the guide rails 24. As shown in FIG. 4, the sides 19, 21 of the car frame 14 are adjacent opposite sides 23, 25 of a hoistway 27 to which the guide rails 24 are attached. The guide rails 24 run the length of the hoistway 27 and are centered along the guide axes 16, one of which axes is shown in FIG. 3. The roller guides 18 are movably engaged with the guide rails 24 to guide the car 12 and the frame 14 up and down the hoistway 27. Arranging the roller guides 18 below the sheaves 20 and the belts 22, as shown in the embodiment of FIGS. 3 and 4, creates openings at the top 13 of the car frame 14 and the car 12 for at least one additional set of sheaves 20 and a corresponding belt 22 and enables the alignment of one of the belts 22 (and the sheaves 20 that engage the belt 22) with the guide axes 16.

Although FIG. 3 shows a set of five sheaves 20 and a corresponding set of five belts 22, the number and placement of the sheaves and corresponding belts may vary across different embodiments of the present invention. For example, embodiments of the invention may involve two, three, four, or six or more belts. By way of specific example, one embodiment may include a set of three sheaves on each side 19, 21 of the car frame and three belts, with one of the three sheaves in each set and one of the three belts aligned with the guide axes of the car. The two remaining sheaves in each set and the two remaining belts may be arranged on opposite sides of the guide axes of the car, for example, one of the remaining sheaves in each set could be positioned toward the front 15 of the car frame and the other remaining sheaves in each set could be positioned toward the back 17 of the car frame respectively. Embodiments of the present invention also include a car frame and a car guided along guide rails by sliding guides, instead of roller guides. Additionally, the car frame and the car may be pulled up and let down the hoistway by ropes, instead of belts, looped around sheaves connected to the top of the car frame in a position vertically above the guides, e.g., roller guides or sliding guides.

Elevator systems according to the present invention provide significant advantages over prior systems by simultaneously increasing the duty and the ride quality of the elevator car. Arranging the guides, such as roller guides or sliding guides, below the sheaves and traction members, for example belts or ropes, at the top of the car allows for placement of a traction member in alignment with the guide axes of the car. Moreover, the additional traction member in alignment with the guide axes facilitates increasing the duty of the elevator car.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

The invention claimed is:

1. An elevator car assembly comprising:

a car frame;

a car connected to the car frame and having a first guide axis between a first side and a second side of the car frame;

a plurality of traction members;

a first plurality of sheaves rotatably connected to the car frame between the first side and the second side for respectively receiving the plurality of traction members; and a first guide attached to either the car frame or the car below the first plurality of sheaves for movably engaging a first rail;

wherein the first guide is aligned with the first guide axis and is configured to be aligned with the first rail; and wherein one of the plurality of traction members, the first guide, and the first guide axis are aligned in a vertical plane that is perpendicular to a rotational axis of the first plurality of sheaves, so that the one traction member is centered on the vertical plane.

2. The assembly of claim 1, wherein the first guide axis is provided substantially halfway between the first and second side of the car frame along a third side of the car frame.

3. The assembly of claim 2, wherein the plurality of traction members comprises five traction members.

4. The assembly of claim 3, wherein the first plurality of sheaves comprises five sheaves.

5. The assembly of claim 4, wherein one of the five traction members is vertically aligned with the first guide at the first guide axis and the remaining four of the five traction members are arranged in equal numbers on opposite sides of the first guide axis.

6. The assembly of claim 1, wherein each of the plurality of traction members is selected from a group of traction members consisting of belts and ropes.

7. The assembly of claim 1, wherein the first guide is selected from a group of guides consisting of rollers and slides.

8. The assembly of claim 1, wherein the first guide axis is provided along a third side of the car frame; and wherein the car has a second guide axis between the first side and the second side provided along a fourth side of the car frame.

9. The assembly of claim 8, further comprising:

a second plurality of sheaves rotatably connected to the car frame between the first side and the second side for respectively receiving the plurality of traction members; and a second guide attached to either the car frame or the car below the second plurality of sheaves for movably engaging a second rail;

wherein the second guide is aligned with the second guide axis and is configured to be aligned with the second rail; and wherein one of the plurality of traction members and the second guide are vertically aligned at the second guide axis.

10. The assembly of claim 9, wherein the first guide axis is provided substantially halfway between the first and second sides of the car frame along the third side of the car frame; and wherein the second guide axis is provided substantially halfway between the first and second sides of the car frame along the fourth side of the car frame.

11. The assembly of claim 10, wherein the plurality of traction members comprises five traction members.

12. The assembly of claim 11, wherein the first plurality of sheaves and the second plurality of sheaves each comprise five sheaves.

13. The assembly of claim 12, wherein one of the five traction members is vertically aligned with the first guide at the first guide axis and the second guide at the second guide axis and the remaining four of the five traction members are arranged in equal numbers on opposite sides of the first guide axis and the second guide axis.

14. The assembly of claim 9, wherein each of the plurality of traction members is selected from a group of traction members consisting of belts and ropes.

15. The assembly of claim 9, wherein the first guide is selected from a group of guides consisting of rollers and slides.

16. The assembly of claim 15, wherein the second guide is selected from a group of guides consisting of rollers and slides.

17. An elevator system comprising:

a hoistway;

one or more rails vertically disposed in the hoistway and respectively defining one or more guide axes; and an elevator car assembly comprising:

a car frame connected to a car and arranged with the one or more guide axes between a first side and a second side of the car frame;

a plurality of traction members;

a plurality of sheaves rotatably connected to the car frame between the first side and the second side for respectively receiving the plurality of traction members; and one or more guides attached to either the car or the car frame below the plurality of sheaves for respectively movably engaging the one or more rails;

wherein the one or more guides are respectively aligned with the one or more guide axes; and wherein one of the plurality of traction members is aligned with the one or more guides in a vertical plane which passes through the one or more guide axes and is perpendicular to a rotational axis of the plurality of sheaves, so that the one traction member is centered on the vertical plane.

18. The system of claim 17, wherein the one or more rails comprises:

a first rail that defines a first guide axis; and a second rail that defines a second guide axis;

wherein the first guide axis is provided along a third side of the car frame; and wherein the second guide axis is provided along a fourth side of the car frame.

19. The system of claim 18, wherein the plurality of sheaves comprises:

a first plurality of sheaves rotatably connected to the car frame between the first side and the second side toward the third side for respectively receiving the plurality of traction members; and a second plurality of sheaves rotatably connected to the car frame between the first side and the second side toward the fourth side for respectively receiving the plurality of traction members;

wherein one of the plurality of traction members is vertically aligned with the first guide axis and the second guide axis.

20. The system of claim 19, wherein the first guide axis and the second guide axis are each arranged substantially halfway between the first and second sides of the car frame.

21. The system of claim 17, wherein each of the plurality of traction members is selected from a group of traction members consisting of belts and ropes.

22. The system of claim 17, wherein each of the one or more guides is selected from a group of guides consisting of rollers and slides.

* * * * *